US007328816B2

(12) United States Patent
Shannon et al.

(10) Patent No.: US 7,328,816 B2
(45) Date of Patent: Feb. 12, 2008

(54) BEVERAGE DISPENSER

(75) Inventors: David Shannon, Edmond, OK (US); Richard McDonagh, Oklahoma City, OK (US); Ronald J. Meredith, Edmond, OK (US); Martin R. Benning, Edmond, OK (US); Kent A. Birt, Moore, OK (US); Larry B. Henderson, Oklahoma City, OK (US)

(73) Assignee: Carlisle FoodService Products, Incorporated, Oklahoma City, OK (US)

( * ) Notice: Subject to any disclaimer, the term of this patent is extended or adjusted under 35 U.S.C. 154(b) by 436 days.

(21) Appl. No.: 10/760,803

(22) Filed: Jan. 20, 2004

(65) Prior Publication Data

US 2005/0155982 A1 Jul. 21, 2005

(51) Int. Cl.
*B67D 5/60* (2006.01)

(52) U.S. Cl. ..... 222/131; 220/592.16

(58) Field of Classification Search ..... 222/131, 222/185.01, 146.1, 592.02, 592.03, 153.1; 220/592.16–592.2, 592.09, 592.1, 787–795, 220/183, 542, 802–804, 62.12, 297, 315; 215/355–357

See application file for complete search history.

(56) References Cited

U.S. PATENT DOCUMENTS 303,558 A * 8/1884 Campbell ..... 215/360
2,533,930 A * 12/1950 Harr ..... 222/57
2,665,028 A * 1/1954 Hintz ..... 220/300
3,059,452 A * 10/1962 Griffin ..... 62/457.2
3,843,020 A 10/1974 Bardeau et al.
3,844,443 A * 10/1974 Cudzik ..... 220/296
3,910,461 A * 10/1975 Eager ..... 222/131
3,985,269 A 10/1976 Bardean et al.
4,049,148 A * 9/1977 Suhr et al. ..... 215/214
4,053,078 A * 10/1977 Herr ..... 215/222
4,099,642 A * 7/1978 Nergard ..... 220/715
4,181,243 A * 1/1980 Frahm ..... 222/189.06
4,520,950 A 6/1985 Jeans
4,531,383 A * 7/1985 Zimmermann ..... 62/457.4
4,555,371 A 11/1985 Jeans
4,651,862 A 3/1987 Greenfield, Jr.
4,768,664 A * 9/1988 Zimmermann ..... 215/12.1
4,778,077 A * 10/1988 Snyder ..... 220/295
5,680,954 A * 10/1997 Arnold et al. ..... 220/300
5,918,761 A * 7/1999 Wissinger ..... 220/713
5,971,218 A * 10/1999 Le ..... 222/185.1

OTHER PUBLICATIONS

Carlisle FoodService Products Catalog, Sep. 2003, p. 148, shows prior art beverage dispensers.

* cited by examiner

*Primary Examiner*—Lien M. Ngo
(74) *Attorney, Agent, or Firm*—McAfee & Taft

(57) ABSTRACT

A food and beverage dispenser with a dispenser lid and a dispenser body. The dispenser body has four walls and a bottom. The dispenser lid seats on the dispenser body. The dispenser lid is secured to the body by cooperation of the lid with the body. Rotation of the lid causes a seal bead on the lid to seal against a seal bead on the body. The dispenser lid is a polyethylene shell, and the seal bead on the dispenser lid is an elastomeric gasket secured to the polyethylene shell.

35 Claims, 10 Drawing Sheets

BEVERAGE DISPENSER

BACKGROUND OF THE INVENTION

The current invention relates to a food and beverage dispenser for dispensing liquids and more particularly to a food and beverage dispenser for dispensing beverages, and liquid foods such as soups through a spigot mounted in a wall of the dispenser.

There are a number of different types of beverage dispensers utilized for containing and dispensing beverages and/or liquid foods. Such beverage dispensers typically are comprised of a dispenser body for containing the liquid and a dispenser lid for sealing against the dispenser body. A spigot is generally mounted in the body to dispense the liquids held within the body. The dispenser lid generally has a groove in which a seal is removably mounted. When the dispenser lid is placed on the dispenser body, the seal will engage the dispenser body. The lid is typically pulled downwardly by latches so that the seal will engage the dispenser body to provide a leak-proof seal between the dispenser lid and the dispenser body. The latches generally include a lever portion that is pivotally mounted to a wall of the dispenser body and a hook portion that is pivotally mounted to the lever portion. The hook portion will engage the lid so that when the operating lever or lever portion is rotated downwardly, it will cause the lid to be pulled downwardly to create a leak-proof seal. There are a number of different latch configurations and prior art dispensers. Prior art dispensers may include two latches on opposite sides of the dispenser body for a total of four latches or may simply include a single latch on each side so that the dispenser has two total latches. In any event, the prior art manner of sealing the lid to the body comprises pulling the lid downwardly with latches so that an elastomeric or other sealing ring is pulled into sealing engagement with the dispenser body. Prior art dispensers described herein work well and generally will provide a leaf-proof or at least a substantially leak-proof seal between the dispenser lid and the dispenser body. Such dispensers, however, utilize a number of working parts including the latch levers, latch hooks, in addition to the pins needed to attach the hook to the latch, brackets to attach the latch to the dispenser, and often require molded-in metal backup plates. In some circumstances, it may be desirable to have a dispenser with fewer working parts and with no metal parts that will provide the desired sealing arrangement. The current invention provides such a beverage dispenser.

SUMMARY OF THE INVENTION

The current invention is directed to a beverage dispenser for holding and dispensing beverages and/or liquid foods (referred to collectively herein as beverages). The beverage dispenser has a dispenser body which defines a body interior for holding beverages and a dispenser lid for covering the body interior. A bead on the dispenser body circumscribes an upper end, or upper opening of the body interior. The bead is preferably integrally formed with the dispenser body, but may comprise a gasket secured to and thus forming a part of the dispenser body. The dispenser lid has a seal thereon for engaging the dispenser body. The seal on the lid may be integrally formed with the lid, but is preferably an elastomeric, deformable seal, which may be referred to as a gasket seal, that is removably secured to the dispenser lid.

The dispenser lid is rotatable between a fully open, or removed position and a fully closed position. When the dispenser lid is in the fully closed position, the seal on the dispenser lid will sealingly engage the dispenser body around the periphery of the upper opening of the body interior. The dispenser body has a pair of upstanding flanges extending above the upper opening of the body interior. Closure grooves are defined in the upstanding flanges. The closure grooves slope from an entrance end to a terminating end downwardly toward the upper opening of the body interior.

The dispenser lid is received in and is rotatable in the closure grooves. Preferably, the closure grooves are arcuately shaped, and the dispenser lid has arcuately shaped rails which are received in and cooperate with the arcuately shaped closure grooves. The rails on the dispenser lid slope downwardly from a termination end thereof to an entrance end thereof towards a seal on the dispenser lid. Rotation of the dispenser lid in a first direction will cause the rails to engage the grooves such that the dispenser lid is urged downwardly into sealing engagement with the dispenser body. Rotation in a second direction moves the dispenser lid from its fully closed to the fully open position. Rotation of less than a full rotation of 360°, and preferably of less than one-half rotation of 180° will move the dispenser lid between its fully closed and fully removed positions. The dispenser lid thus cooperates with the dispenser body without any additional parts to place the dispenser lid into sealing engagement with the dispenser body.

The dispenser lid may have a first, or upper lid portion and a second, or lower lid portion, with the upper portion being rotatable relative to the lower portion. The seal is located on the lower lid portion, and the upper lid portion is received in the closure grooves. When the upper lid portion is rotated in the first direction in the closure grooves, the lower lid portion is moved into sealing engagement with the body. Rotation of the upper lid portion in the first direction will urge the lower lid portion downwardly so that it sealingly engages an interior surface that defines the body interior. When the seal on the lower lid portion initially engages the dispenser body, the lower lid portion will not rotate at all or will rotate only slightly as the upper lid portion is rotated in the first direction relative to the body and the lower lid portion to move the lid to the closed position.

DESCRIPTION OF THE DRAWINGS

FIG. 9 is a cross-sectional view looking towards the forward end of the beverage dispenser.

DESCRIPTION OF A PREFERRED EMBODIMENT

Figure 1:
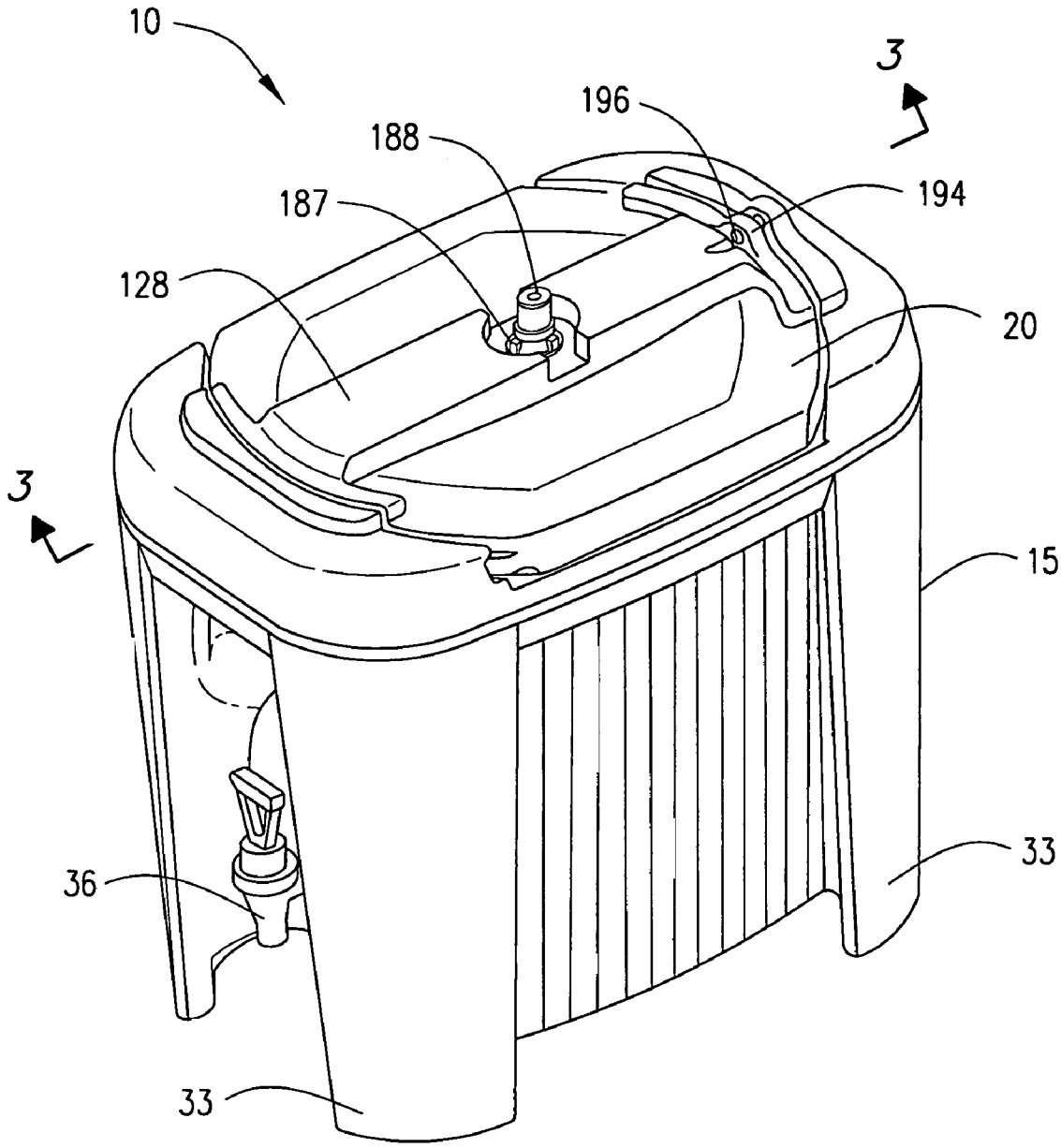
FIG. 1 is a perspective view of the beverage dispenser with the dispenser lid in a fully closed position.
Figure 2:
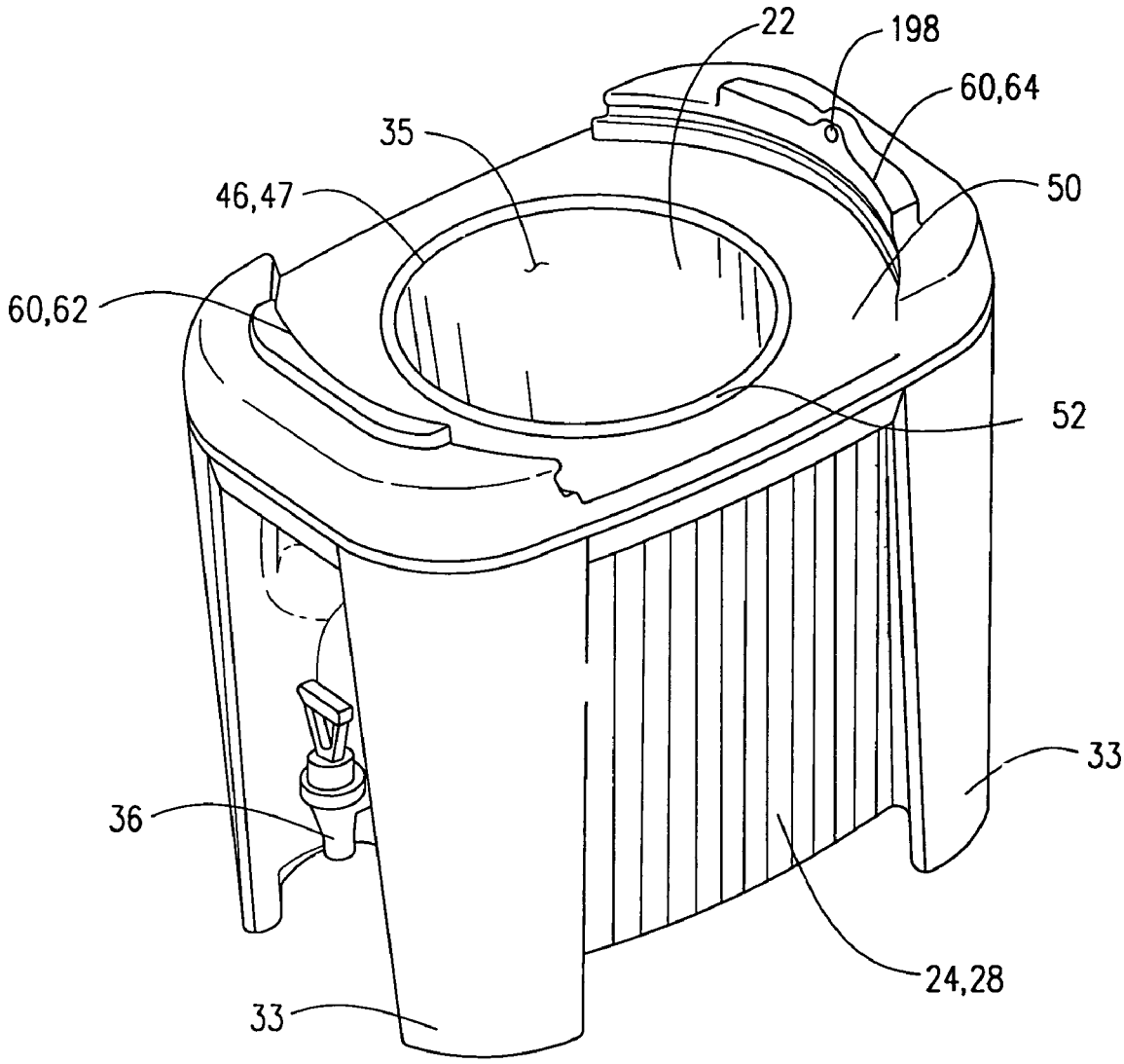
FIG. 2 is a perspective view of the beverage dispenser with the dispenser lid in a fully open or fully removed position.
Figure 3:
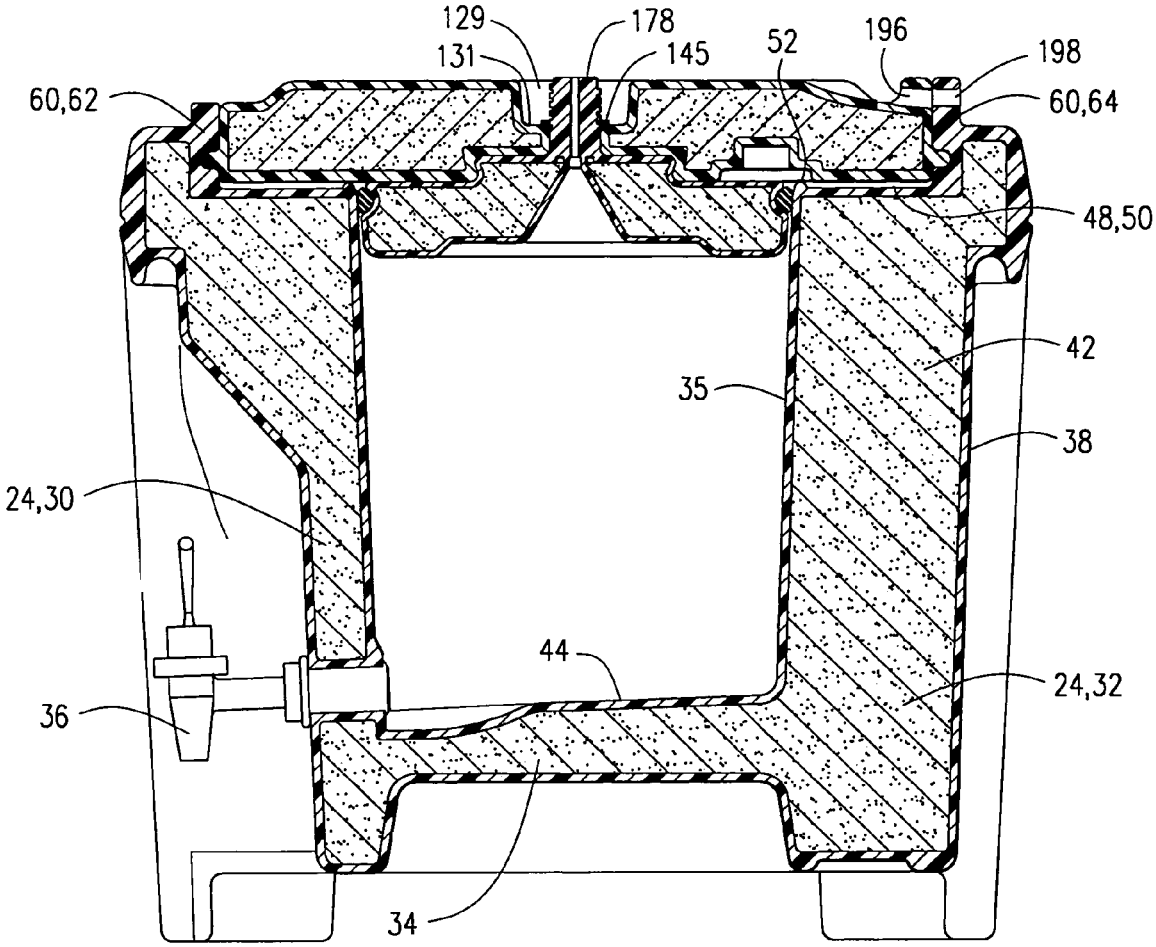
FIG. 3 is a cross-sectional view of the beverage dispenser of the current invention.

Referring now to the drawings and more particularly to FIG. 1, a beverage dispenser 10 is shown. Beverage dispenser 10 includes a dispenser body 15 and a dispenser lid 20. Dispenser lid 20 cooperates with dispenser body 15 to create a seal, which is preferably a hermetic, or leak-proof seal. As will be explained in more detail hereinbelow, dispenser lid 20 is rotatable relative to dispenser body 15. Rotation in a first or clockwise direction as viewed in FIG. 2 will move the lid from its fully open to the fully closed position shown in FIG. 1 wherein dispenser lid 20 sealingly engages dispenser body 15. Rotation in a second or counterclockwise direction as viewed in FIG. 1 will move dispenser lid 20 from its fully closed to the fully open or fully removed position shown in FIG. 2. A body interior 22 in which beverages can be contained is defined by dispenser body 15. No additional working parts such as latches, hinges or pins are required to move dispenser lid 20 into sealing engagement with dispenser body 15. Thus, beverage dispenser 10 is of two-piece working construction, which simply means that dispenser lid 20, which as explained in more detail is a lid comprised of an upper lid portion and a lower lid portion, can be moved into sealing engagement with dispenser body 15 without the aid of any additional working pieces such as pins, latches or hooks to draw dispenser lid 20 down into sealing engagement with the dispenser body 15. Rotation of lid 20 alone will move lid 20 to its closed position, where it sealingly engages dispenser body 15.

Dispenser body 15 has four upstanding walls 24 including left and right side walls 26 and 28, respectively, and forward and rear walls 30 and 32, respectively, and has a bottom wall 34. Dispenser body 15 may have legs 33 at the corners thereof. Body interior 22 is defined by upstanding walls 24 and bottom wall 34 which define interior surface 35. Body interior 22 is thus defined by interior surface 35. A spigot 36 is mounted in forward wall 32 and will dispense beverages contained in body interior 22 therethrough. Spigot 36 may be of any type known in the art utilized for dispensing beverages from beverage dispensers. Dispenser body 15 is preferably comprised of a hollow shell 38 filled with an insulating foam 42. Hollow shell 38 is comprised of plastic, and is preferably a polyethylene shell filled with insulating foam 42 of a type known in the art.

Body interior 22 has a bottom 44 and an upper opening 46 through which beverages can be placed into dispenser body 15. Upper opening 46 has a periphery 47. Upstanding walls 24 define an upper surface 48 comprised of a generally flat or planar surface 50 and a rounded surface 52 that extends upwardly from planar surface 50. Rounded surface 52 may be referred to as a bead 54. Bead 54 is positioned at or near upper opening 46.

Dispenser body 20 may be made by any means known in the art, such as blow molding and injection molding, but is preferably a rotationally molded dispenser body which, as explained hereinabove, is filled with insulating foam 42. Rotational molding is known in the art. Bead 54 is preferably integrally formed as part of the rotationally molded dispenser body 15.

Dispenser body 15 has a pair of opposed marginal end walls 60 which may also be referred to as opposed upstanding flanges 60. Upstanding flanges 60 extend upwardly from upper surface 48 and include a first or forward upstanding flange 62 and a second or rear upstanding flange 64. Forward upstanding flange 62 has an arcuately shaped inner surface 66 and second upstanding flange 64 has an arcuately shaped inner surface 68. A pair of opposed closure grooves 70 are defined in inner surfaces 66 and 68. More specifically, a first closure groove 72 which is an arcuately shaped closure groove 72 is defined in arcuately shaped inner surface 66, and a second or rear closure groove 74 which is an arcuately shaped closure groove 74 is defined in inner surface 68. Preferably, closure grooves 72 and 74 will have the same radii of curvature measured from a common center point.

Figure 8:
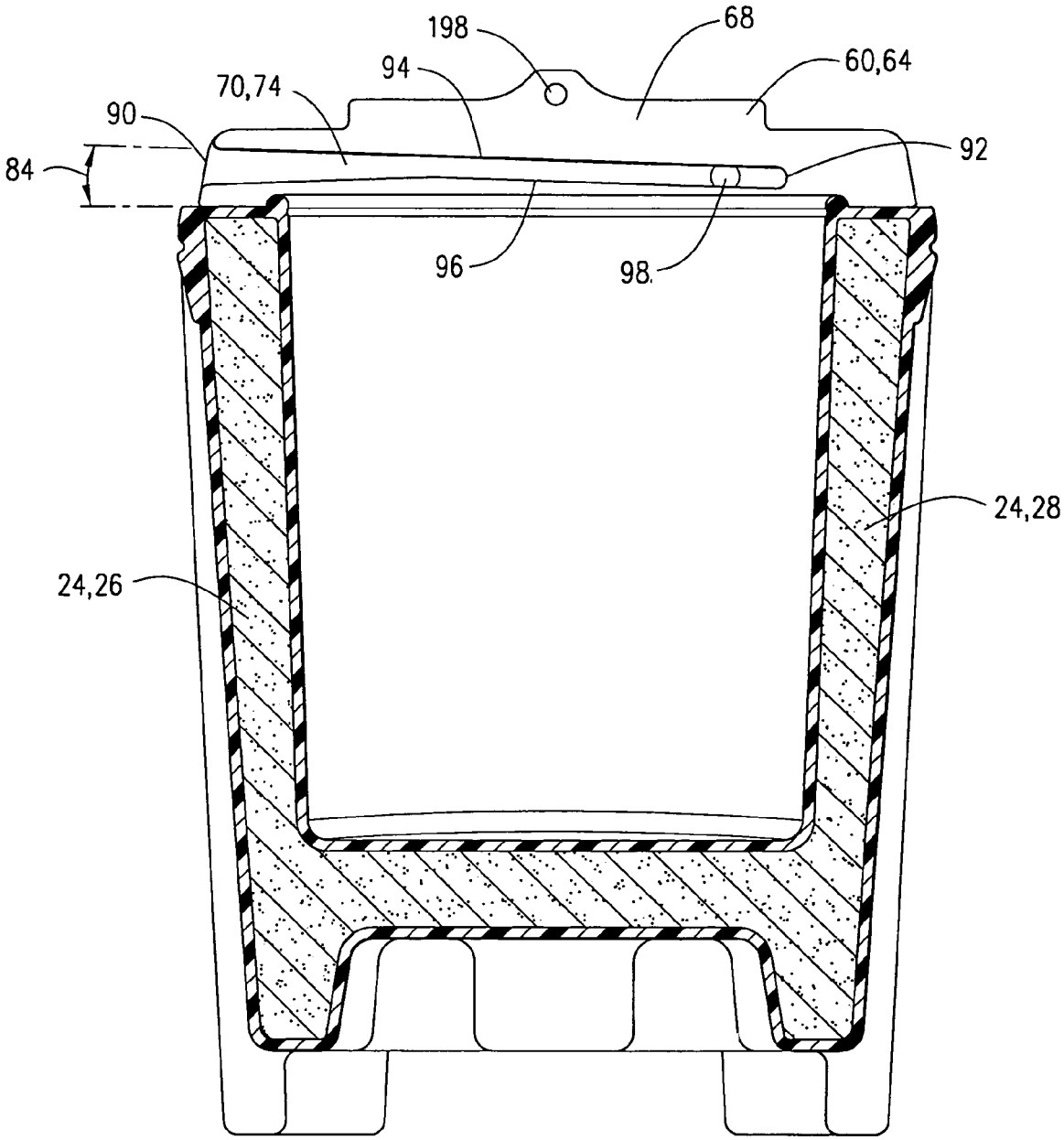
FIG. 8 is a cross-sectional view looking towards the rear of the beverage dispenser.
Figure 8:
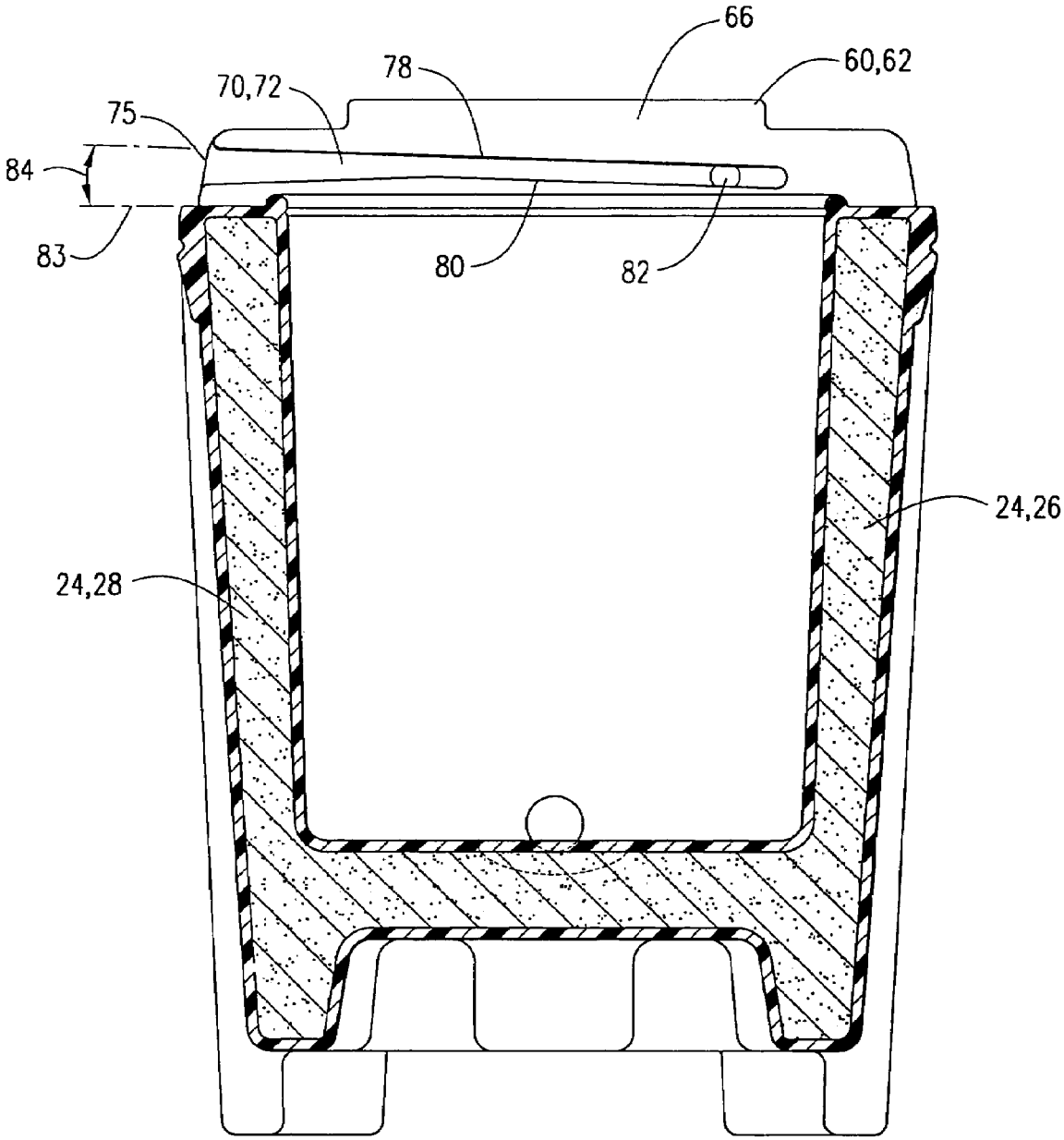
Figure 10:
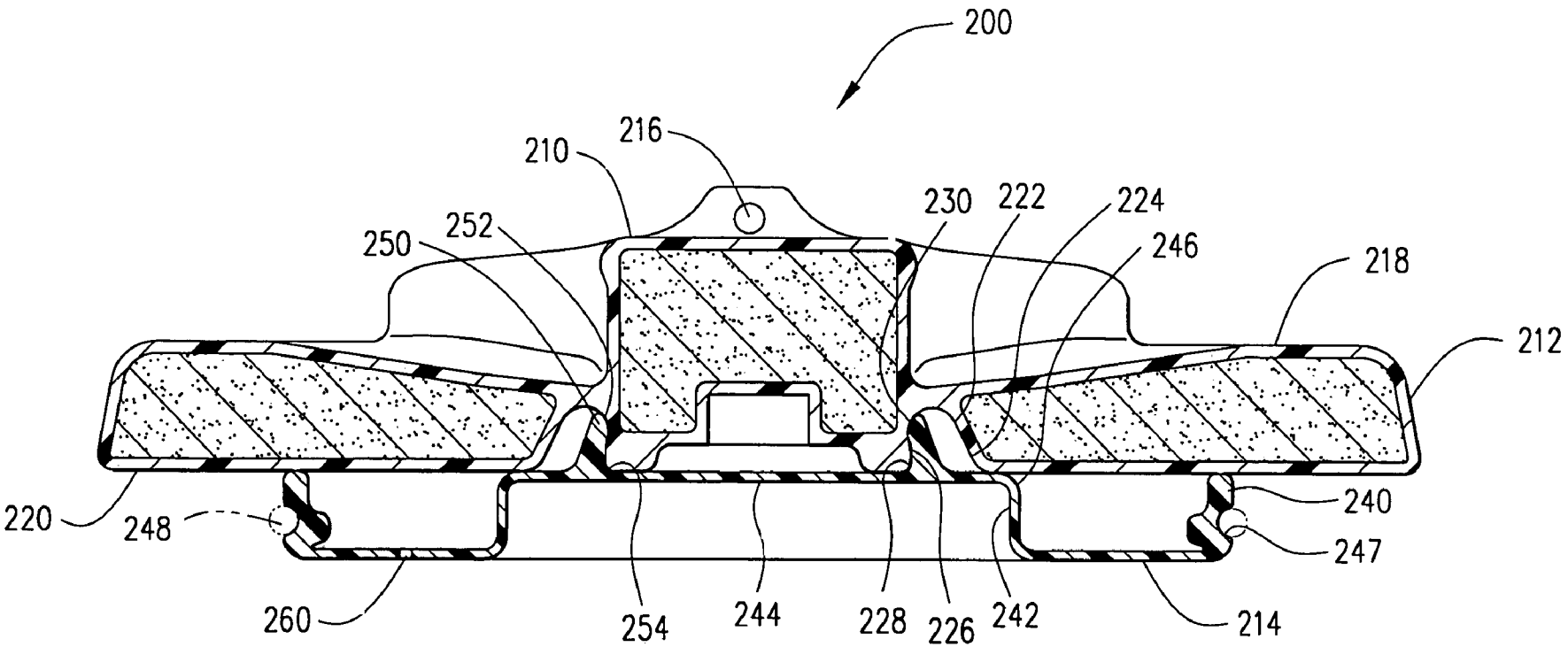
FIG. 10 is a cross-sectional view of an additional embodiment of the lid of the current invention.

First closure groove 72 has an entrance point or entrance end 75 and a termination end 76. Groove 72 is wider at the entrance end, or first end 75 than it is at termination end, or second end 76 and thus narrows from the entrance end to the termination point 76. Closure groove 72 has an upper side 78 and a lower side 80. Upper side 78 slopes downwardly in a direction toward planar surface 50 from the entrance end 75 to the terminating end 76 of closure groove 70. Closure groove 70 may have an inwardly extending node 82 disposed therein. Upper side 78 preferably forms an angle 84 with a plane, represented by line 83, defined by planar surface 50 which is preferably horizontal as viewed in FIGS. 8 and 9. Angle 84 is approximately one to three degrees and more preferably is approximately two degrees.

Closure groove 74 has an entrance, or first end 90 and a termination, or second end 92. Closure groove 74 is preferably wider at entrance end 90 than at termination end 92. Closure groove 74 has upper side 94 and lower side 96. Upper side 94 slopes downwardly from entrance end 90 to termination end 92 thereof towards planar surface 50. Preferably, upper side 94 slopes downwardly at the same angle as upper side 78 of arcuately shaped closure groove 72. Closure groove 74 has an inwardly extending node 98.

Figure 4:
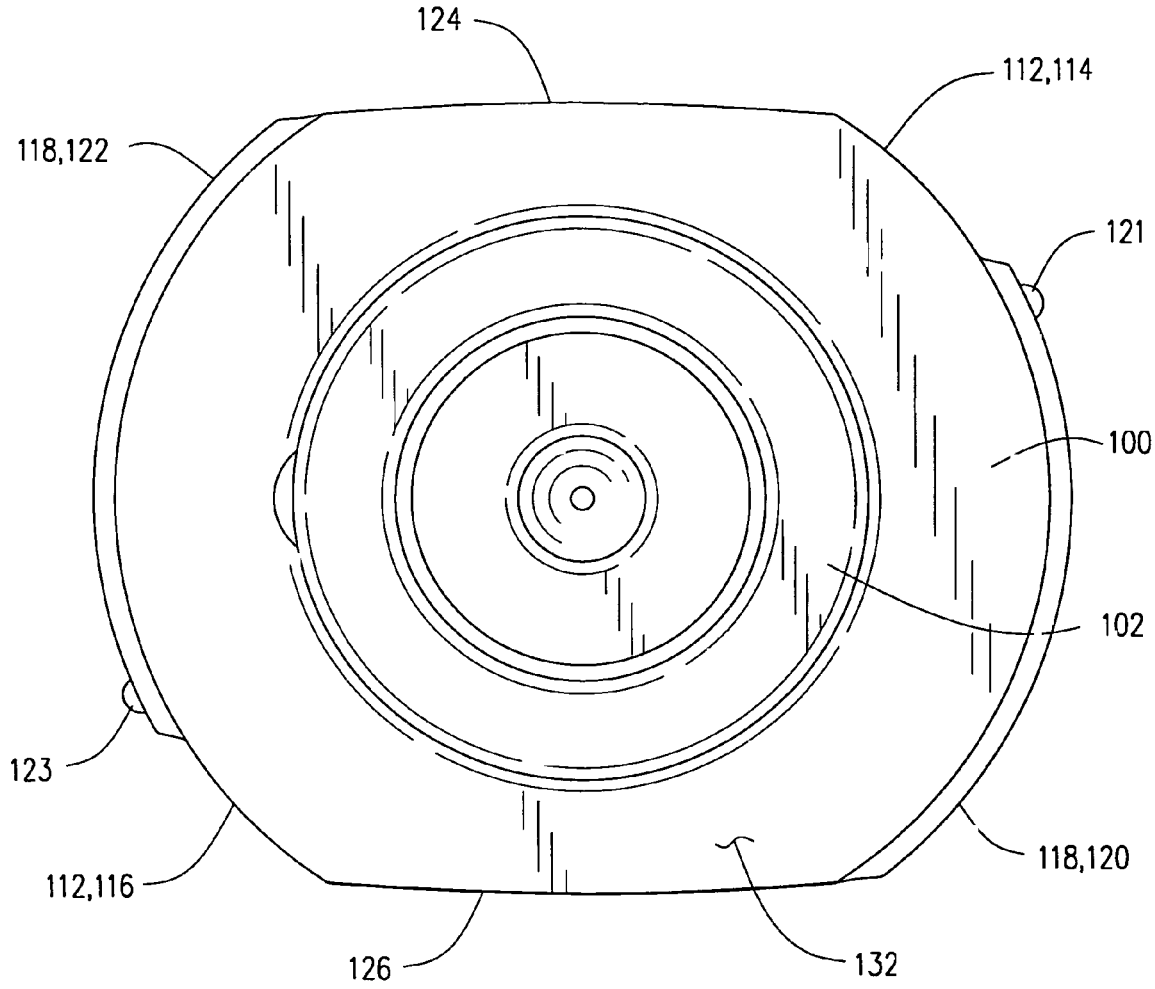
FIG. 4 is a view of the underside of the dispenser lid of the current invention.
Figure 5:
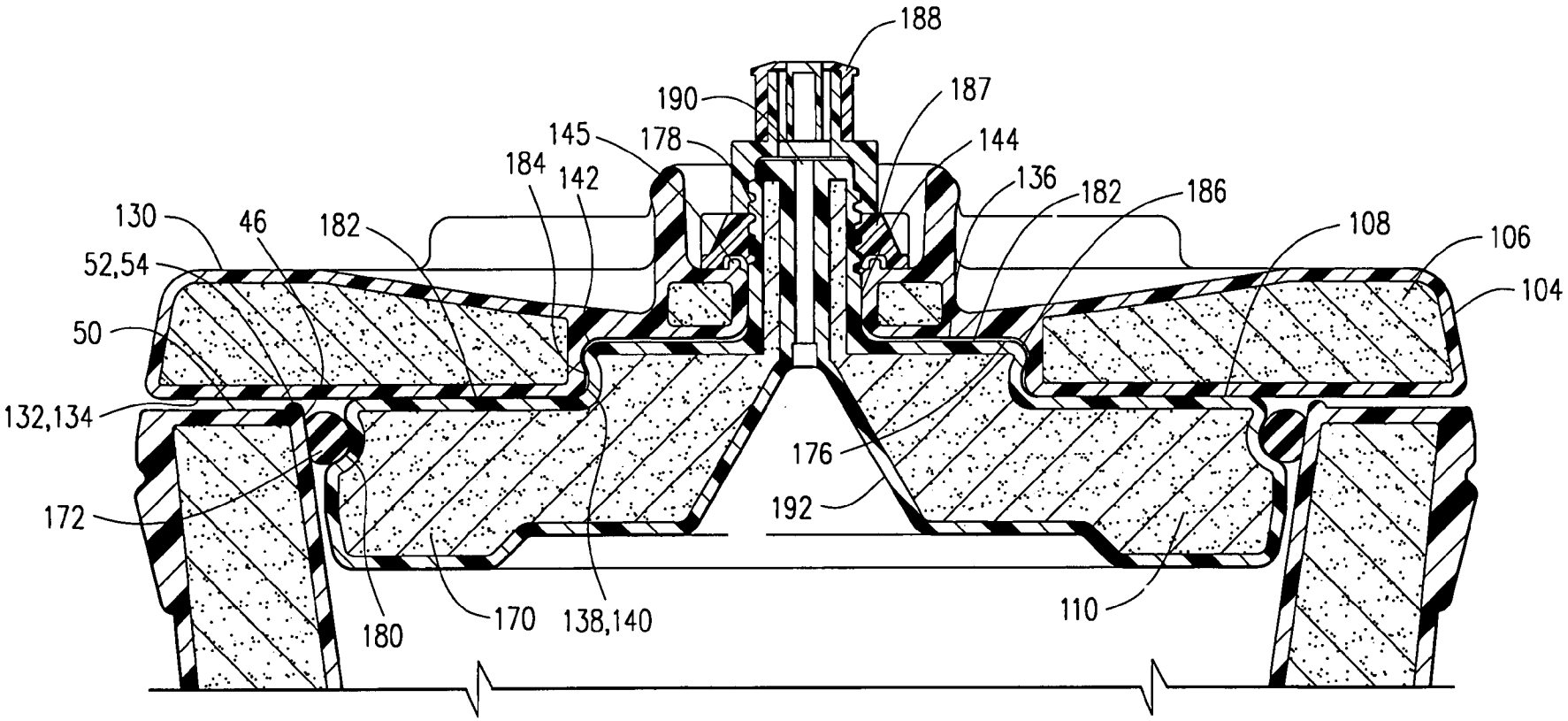
FIG. 5 is a cross-sectional view of the lid of the current invention.

Referring now to FIG. 4, an underside of dispenser lid 20 is shown. Dispenser lid 20 comprises an upper lid portion 100 and a lower lid portion 102. Upper lid portion 100 is preferably comprised of a hollow shell 104 having an insulating foam 106 therein. Lower lid portion 102 is preferably comprised of a hollow shell 108 with insulating foam 110 therein. Shells 104 and 108 are preferably comprised of the same material as shell 38 of dispenser body 15 and insulating foam 106 and 110 are preferably the same as insulating foam 42. Upper and lower lid portions 100 and 102 are preferably rotationally molded but may be made by any manner known in the art. Dispenser lid 20, and preferably upper lid portion 102, has a pair of arcuately shaped edges 112, which may include first or forward arcuately shaped edge 114 and second or rear arcuately shaped edge 116. Edges 112 define arcuately shaped rails 118, which include a first or forward arcuately shaped rail 120, and a second or rear arcuately shaped rail 122. Rails 120 and 122 may have upraised portions or nubs 121 and 123, respectively. Dispenser lid 20 has left and right edges or sides 124 and 126, respectively, extending between forward and rear edges 114 and 116 on upper lid portion 100. A handle 128 may be molded in the upper lid portion 104 of dispenser lid 20. Handle 128 has a cutout 129 at or near the center thereof. Cutout 129 has a bottom surface 131.

Handle 128 is located on the upper or top side 130 of upper lid portion 100, which is the top side of lid 20. Upper lid portion 100 has an underside, or lower surface 132. Lower surface 132 comprises a generally planar or flat surface 134 that extends inwardly from the edges of upper lid portion 100 and has a recess, or cavity 136 defined therein. Recess 136 comprises a lip, or lip portion 138 at the entrance 140 of recess 136, and has a groove, or groove portion 142 positioned radially outwardly from lip 138. Upper lid portion 100 has a through hole, or opening 144 extending therethrough from recess 136. Opening 144 extends through cutout 129. A lip 145 defined on bottom surface 131 circumscribes opening 144.

Figure 6:
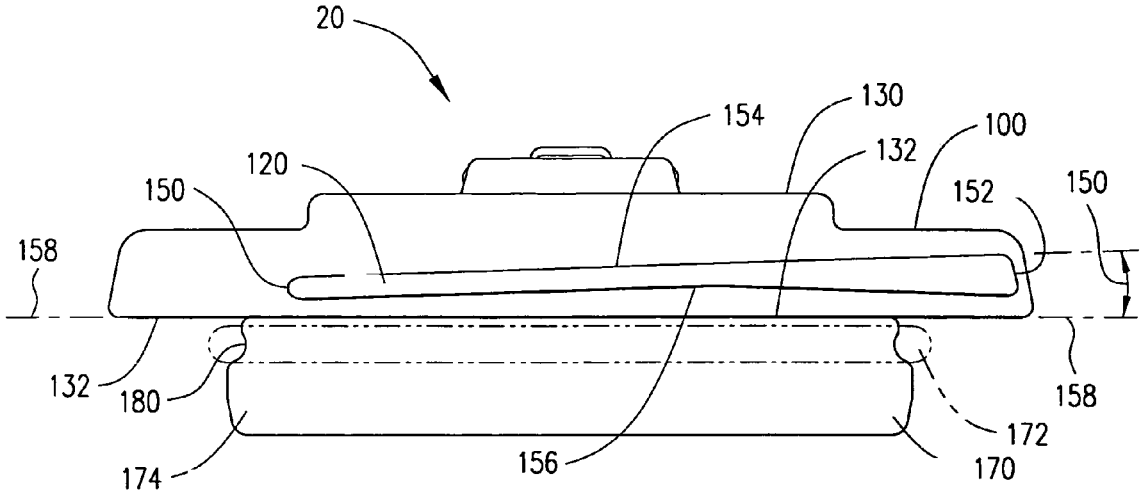
FIG. 6 is a view looking at the forward edge of the dispenser lid.
Figure 7:
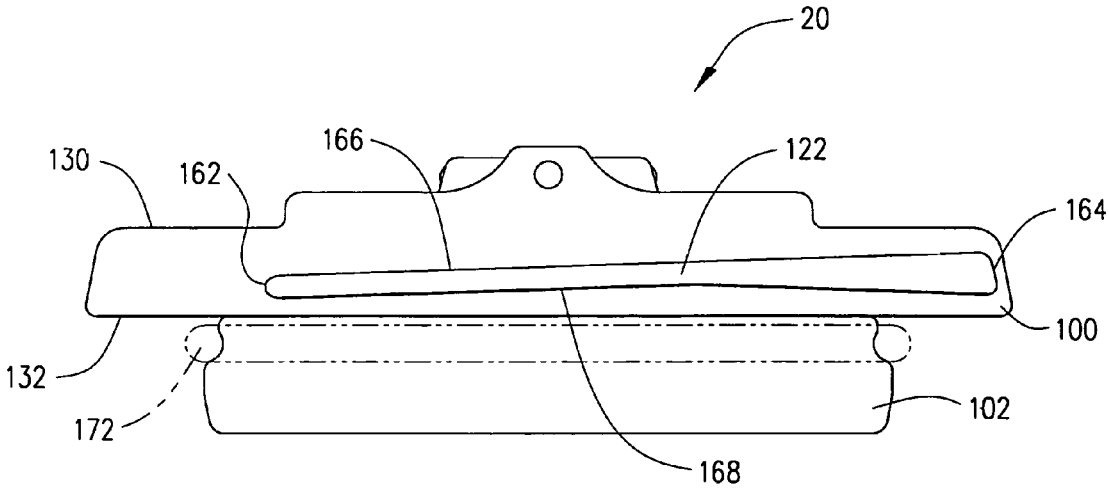
FIG. 7 is a view looking at the rear edge of the dispenser lid.

Referring now to FIGS. 6 and 7, first rail 120 has an insertion or first end 150 and a second or terminating end 152. First rail 120 is wider at its termination end 152 than at its insertion end 150. First rail 120 has an upper side 154 and a lower side 156. Upper side 154 slopes downwardly from the terminating end 152 thereof to the insertion end 150 thereof towards a plane defined by planar surface 134, represented in FIG. 6 by the number 158. Upper side 154 forms angle 160 with plane 158. Angle 160 is approximately one to three degrees and is more preferably approximately two degrees. Second rail 122 has a first or insertion end 162 and a second or termination end 164. Second rail 122 has an upper side 166 and a lower side 168. Second rail 122 is preferably wider at its terminating end 164 than at its insertion end 162. Upper side 166 slopes downwardly towards plane 158 at angle 160 from terminating end 164 to insertion end 162.

To place dispenser lid 20 on dispenser body 15, insertion ends 150 and 162 are placed in entrance ends 75 and 90 of closure grooves 72 and 74, respectively. Because of the downward slope of upper sides 78 and 94 of first and second closure grooves 72 and 74, upper sides 154 and 166 of first and second rails 120 and 122 will engage sides 78 and 94 when lid 20 is rotated in the first direction, which will cause dispenser lid 20 to move downwardly. Nubs 121 and 123 will rotate past nodes 82 and 98, to help hold, or lock lid 20 in place in the closed position. Thus, rotation in a clockwise direction will cause lid 20 to sealingly engage dispenser body 15. More specifically, rotation to the fully closed position will urge lower lid portion 102 into sealing engagement with dispenser body 15.

Lower lid portion 102 comprises a body 170 with a seal 172 thereon. Seal 172 is preferably a deformable elastomeric seal. Seal 172 sealingly engages dispenser body 15, and more specifically, interior surface 35 when lid 20 is in the closed position.

Body 170 comprises a shelf, or shelf portion 174, a cap, or cap portion 176 extending upwardly from shelf portion 174, and a neck or stem which is preferably a threaded neck 178 extending upwardly from cap portion 176. Seal 172 is received in a groove 180 defined on shelf portion 174, and preferably is removably fitted in groove 180. If desired, seal 172 may be bonded, or otherwise affixed in groove 180.

Shelf portion 174 defines a shelf surface, or upper surface 182. Cap portion 176 defines a generally circular groove 184 and a generally circular lip 186 positioned above and radially outwardly from groove 184. Threaded neck 178 extends upwardly through opening 144. Lower lid portion 102 is connected to upper lid portion 100 such that upper lid portion 100 is rotatable relative to lower portion 102. Preferably, cap 176 is snapped, or urged into recess 136 so that lip 186 on cap 176 is received in groove 142 in recess 136. Likewise, lip 138 is received in groove 184 on cap 140. A threaded nut 187 may be threaded onto threaded neck 178, and may be positioned over bead 145. A vent cap 188 may be threaded to threaded neck 178. Vent cap 188 may be opened when liquid is being dispensed from the dispenser 10 to allow venting through vent hole 190 which is communicated with cavity 192. When liquids are dispensed, no vacuum is created and venting is allowed through cavity 192 and vent opening 190. Vent cap 188 may be of a type known in the art and may be, for example, a cap having a threaded base portion and a cap portion that will snap open and closed upon the application of force thereto, like those used on drinking bottles. Alternatively, the vent cap may simply be a threaded cap that can be removed to open vent hole 190.

It is apparent from the drawings it requires less than a full rotation of 360° to move the dispenser lid from the fully open to the full closed position and from the fully closed to the fully open or fully removed position. Preferably, it takes less than 180°, or less than one-half of a full rotation to move between the fully open and fully closed positions. When dispenser lid 20 is in its fully closed position, a hermetic, or leak-proof seal is preferably defined by and between dispenser lid 20 and dispenser body 15, and more preferably between seal 172 and interior surface 35 of dispenser body 15. The hermetic seal is created by cooperation of dispenser lid 20 with dispenser body 15 without the use of any latches, pins or other external pieces. Thus, it is solely the cooperation between dispenser body 15 and the dispenser lid 20 that causes dispenser lid 20 to move downwardly into sealing engagement with dispenser body 15, and more specifically to bring seal 172 into sealing engagement with body 15.

When rails 120 and 122 are placed in closure grooves 72 and 74 and rotated in the first, or clockwise direction, engagement of rails 120 and 122 with grooves 72 and 74 will cause dispenser lid 20 to move downwardly. Seal 172 will engage body 15 and preferably will engage interior surface 35 which defines body interior 22. Seal 172 will initially engage body 15 when the lid 20 is placed thereon. Rotation of upper portion 100 will cause lower portion 102 to move downwardly into intimate contact such that seal 172 sealingly engages body 15 and preferably creates the hermetic seal. Lower lid portion 102 will rotate negligibly, or not at all once seal 172 engages the body since seal 172 will prevent rotation of lower portion 102 as upper lid portion 100 is rotated in the clockwise direction. Thus, rotation of upper lid portion 100 will cause lower lid portion 102 to move downwardly so that seal 172 is deformed, or compressed and will sealingly engage and prevent any leaks from body interior 22. Upper lid portion 100 thus rotates relative to body 15 and lower lid portion 20. Lower lid portion 102 extends downwardly into body interior 22 below seal 172, and is spaced radially inwardly from body interior 22 below seal 172.

Dispenser lid 20 may have an upstanding flange 194 with opening 196 therethrough, which will align with an opening 198 in dispenser body 15 when the dispenser lid 20 is in the closed position. A pin, lock or other device may be inserted through openings 196 and 198 to prevent the inadvertent, or accidental opening, or partial opening of dispenser lid 20.

An additional embodiment of a dispenser lid, designated by the numeral 200 may be used with dispenser body 15. Dispenser lid 200 is similar to lid 20 in that it cooperates with dispenser body 15 in the same manner as dispenser lid 20 and thus has rails 202 and 204 with nubs 206 and 208, respectively. Dispenser lid 200 cooperates with dispenser body 15 in the same fashion as dispenser lid 20 so that arcuately shaped rails 202 and 204 are received in closure grooves 72 and 74 and rotation of lid 200 in the first direction will cause lid 200 to sealingly engage body 15. Lid 200 has a handle 210 and comprises upper lid portion 212 and lower lid portion 214. Upper lid portion 214 has an opening 216 therethrough that will align with opening 198 when dispenser lid 200 is in a closed position. Upper lid portion 212 has an upper or top surface 218 and a lower or bottom surface 220 having a cavity 222 defined therein. Cavity 222 defines a radially outer wall 224 and a radially inner wall 226. Inner wall 226 has a lip 228 and a groove 230 positioned thereabove and radially inwardly therefrom into which lower lid portion 214 is received as will be explained in more detail hereinbelow.

Figure 11:
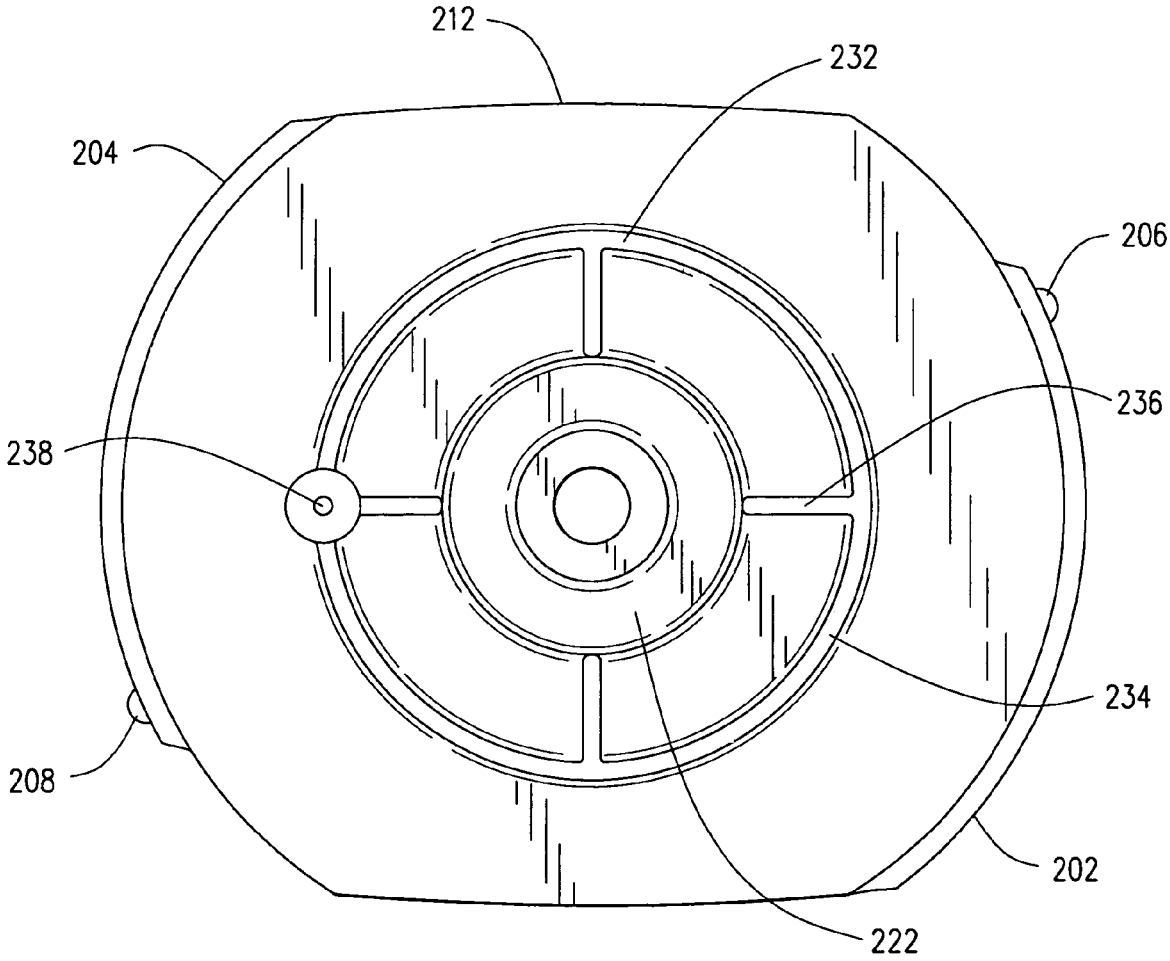
FIG. 11 is a view of the underside of the upper lid portion of the embodiment shown in FIG. 10.

As shown in FIG. 11, lower surface 220 has a plurality of vent grooves 232 which include a generally circular groove 234 and a plurality of radial grooves 236 extending between cavity 222 and circular groove 234. A vent hole 236 extends from bottom surface 220 through upper lid portion 212.

Lower lid portion 214 has an outer wall 240 and an inner wall 242 both of which are generally circular and are concentric so that they form a generally U-shaped cross-section. A platform 244 is positioned at the upper edge 246 of inner radial wall 242. Outer wall 240 has a groove 247 in which a seal, which is preferably a deformable elastomeric seal 248 is disposed. Seal 248 is generally identical to seal 172. A snap ring 250 extends upwardly from platform 244 and defines a lip 252 at an upper end thereof and a groove 254 positioned below and radially outwardly from lip 252. Snap ring 250 is urged, or snapped into cavity 222 such that lip 252 is received in groove 230 and groove 254 is disposed about lip 228. The arrangement will hold upper lid portion 212 and 214 together and at the same time will allow upper lid portion 212 to rotate relative to lower lid portion 214. Lid 200 is positioned on dispenser body 15 in the same manner as described with respect to dispenser lid 20. Seal 248 will engage body 15 and when upper lid portion 212 is rotated in the first direction, lower lid portion 214 is urged downwardly so that seal 248 is in sealing engagement with body 15 and preferably with body interior 22. Upper lid portion 212 will thus rotate relative to body 15 and because lower lid portion 214 will move little and will likely not move at all once seal 248 engages body 15, upper lid portion 212 will rotate relative to lower lid portion 214 as well. When lid 200 is in its closed position, beverages can be dispensed from body 15 with spigot 36 and the body interior may vent through a vent hole 260 disposed in lower lid portion 214 which allows venting through vent hole 236 in upper lid portion 212. If desired, a removable plug can be placed in vent hole 236 when the beverage dispenser is not in use.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A beverage dispenser for dispensing beverages, the beverage dispenser comprising:

a dispenser body, the dispenser body defining a body interior for holding beverages; and a dispenser lid for covering the body interior and comprising an upper lid portion and a lower lid portion, the upper lid portion being rotatable relative to the lower lid portion, wherein the dispenser lid has a deformable seal and is removably attached to the dispenser body by rotation of the lid in a first direction, and wherein the rotation of the lid in the first direction urges the deformable seal into a fully closed position, wherein the deformable seal is in continuous sealing engagement with the body interior, the dispenser lid being rotatable from the fully closed position to a fully removed position with less than one full rotation, the beverage dispenser being capable of dispensing beverages with the dispenser lid in the fully closed position.

2. The beverage dispenser of claim 1, wherein a portion of the dispenser lid extends downwardly into the body interior below the deformable seal.

3. The beverage dispenser of claim 2, wherein the portion of the lid extending downwardly from the seal is spaced radially inwardly from an interior surface which defines the body interior.

4. The beverage dispenser of claim 1, wherein rotation of the upper lid portion in the first direction urges the lower lid portion downwardly into engagement with the dispenser body.

5. The beverage dispenser of claim 4 wherein the lower lid portion moves downwardly after the deformable seal initially engages the dispenser body.

6. The beverage dispenser of claim 5, the lower lid portion having a threaded neck, wherein the threaded neck extends through an opening in the upper lid portion.

7. The beverage dispenser of claim 1, the dispenser lid being rotatable from the fully closed position to the fully removed position with less than one-half of a full rotation.

8. The beverage dispenser of claim 7, the dispenser body comprising a pair of upstanding flanges extending above an upper end of the body interior, wherein the dispenser lid is received and rotatable in grooves defined in the upstanding flanges.

9. A beverage dispenser comprising:

a dispenser body, the dispenser body defining a body interior for holding beverages;

a dispenser lid for covering the body interior, the dispenser lid comprising a first arcuate rail and a second arcuate rail at a first and a second edge thereof, wherein the first and second arcuate rails engage and are rotatable in a first groove and a second groove defined in the dispenser body; and an elastomeric seal removably disposed in a groove on the dispenser lid, wherein the dispenser lid is rotatable between a fully open position wherein the dispenser lid is disengaged from the dispenser body, and a fully closed position wherein the elastomeric seal on the dispenser lid continuously sealingly engages an interior surface of the dispenser body to seal the body interior, the dispenser lid being rotatable from a fully closed position to a fully removed position with less than one full rotation.

10. The beverage dispenser of claim 9, wherein the dispenser lid is movable between the fully open and fully closed positions with less than one-half of a full rotation.

11. The beverage dispenser of claim 9, the dispenser lid comprising:

an upper lid portion; and a lower lid portion, wherein the seal is on the lower lid portion, and wherein the upper lid portion is rotatable relative to the lower lid portion.

12. The dispenser of claim 11, wherein rotation of the upper lid portion in the first direction moves the seal on the lower lid portion downwardly into sealing engagement with the dispenser body.

13. A beverage dispenser comprising:

a dispenser body defining a body interior, the body interior having an upper opening;

a pair of upstanding flanges extending above the upper opening, the upstanding flanges having sloped first and second closure grooves defined therein; and a dispenser lid having first and second rails at first and second edges thereof, the rails being receivable in the closure grooves, wherein rotation of the dispenser lid in a first direction urges a seal on the dispenser lid downwardly into sealing engagement with the dispenser body around the upper opening.

14. The beverage dispenser of claim 13, wherein the seal on the dispenser lid comprises a deformable seal secured to the dispenser lid.

15. The beverage dispenser of claim 13, wherein the dispenser lid moves between the fully open and fully closed positions with less than a full rotation.

16. A beverage dispenser comprising:

a dispenser body;

a spigot mounted in the dispenser body for dispensing liquids from a body interior; and a dispenser lid rotatable between fully open and fully closed positions, the dispenser lid comprising:

an upper lid portion; and a lower lid portion, wherein the upper lid portion is rotatable relative to the lower lid portion, and wherein the dispenser lid cooperates with the dispenser body to create a hermetic seal by moving the lower lid portion downwardly when the upper lid portion is rotated relative to the dispenser body in a first direction to the closed position.

17. The beverage dispenser of claim 16, wherein the dispenser body defines a pair of closure grooves, and wherein the upper lid portion is received in and is rotatable in the closure grooves.

18. The beverage dispenser of claim 17, the upper lid portion having a pair of rails at the edges thereof, wherein the rails are received in and rotatable in the closure grooves.

19. The beverage dispenser of claim 16 wherein rotation of the upper lid portion in the first direction urges the lower lid portion into sealing engagement with the dispenser body.

20. The beverage dispenser of claim 19, wherein the lower lid portion includes a deformable seal, wherein the deformable seal engages the dispenser body to create the hermetic seal in the closed position.

21. The beverage dispenser of claim 19, the dispenser body having an interior surface defining a body interior for holding liquids, wherein the lower lid portion sealingly engages the interior surface in the closed position.

22. The beverage dispenser of claim 21, wherein the lower lid portion comprises a shell with a groove defined therein and an elastomeric seal disposed in the groove.

23. The beverage dispenser of claim 21, the upper lid portion comprising an upper surface and a lower surface, the lower lid portion being received and rotatable in a recess defined in the lower surface of the upper lid portion.

24. The beverage dispenser of claim 16, the upper lid portion comprising:

a top; and a bottom, the bottom having a cavity defined therein, wherein the lower lid portion is received and rotatable in the cavity defined in the upper lid portion.

25. A beverage dispenser for dispensing beverages, the beverage dispenser comprising:

a dispenser body, the dispenser body defining a body interior for holding beverages; and a dispenser lid for covering the body interior, wherein the dispenser lid is removably attached to the dispenser body by rotation of the lid in a first direction, and wherein the rotation of the lid in the first direction urges the dispenser lid into sealing engagement with the dispenser body, the dispenser lid being rotatable from a fully closed position to a fully removed position with less than one full rotation, the dispenser body comprising a pair of upstanding flanges extending above an upper end of the body interior, wherein the dispenser lid is received and rotatable in sloped grooves defined in the upstanding flanges.

26. The beverage dispenser of claim 25 wherein each upstanding flange has a single groove defined therein, and wherein each groove slopes from a groove entrance to a groove terminating end toward the upper end of the body interior.

27. A beverage dispenser comprising:

a dispenser body, the dispenser body defining a body interior for holding beverages;

a dispenser lid for covering the body interior; and a seal on the dispenser lid, wherein the dispenser lid is rotatable between a fully open position wherein the dispenser lid is disengaged from the dispenser body, and a fully closed position wherein the seal on the dispenser lid sealingly engages an interior surface of the dispenser body to seal the body interior, the dispenser lid comprising first and second arcuate rails at first and second edges thereof, wherein the first and second arcuate rails engage and are rotatable in first and second sloped grooves defined in the dispenser body.

28. The beverage dispenser of claim 27, wherein the first and second grooves slope from a first end to a second end thereof towards an upper opening of the body interior.

29. A beverage dispenser for dispensing beverages, the beverage dispenser comprising:

a dispenser body, the dispenser body defining a body interior for holding beverages; and a dispenser lid for covering the body interior, the dispenser lid comprising an upper lid portion and a lower lid portion, the upper lid portion being rotatable relative to the lower lid portion, wherein rotation of the upper lid portion relative to the lower lid portion in a first direction urges the lower lid portion downwardly into sealing engagement with the dispenser body, wherein the beverage dispenser is capable of dispensing beverages from the dispenser body with the lower lid in sealed engagement with the dispenser body.

30. The beverage dispenser of claim 29, wherein the dispenser lid comprises a deformable seal, and wherein the deformable seal sealingly engages the dispenser body.

31. The beverage dispenser of claim 30, wherein a portion of the dispenser lid extends downwardly into the body interior below the deformable seal.

32. The beverage dispenser of claim 31, wherein the portion of the lid extending downwardly from the seal is spaced radially inwardly from the body interior.

33. The beverage dispenser of claim 29, the lower lid portion including a deformable seal disposed in a groove, wherein rotation of the upper lid portion in the first direction moves the deformable seal into sealing engagement with the dispenser body.

34. The beverage dispenser of claim 29, the dispenser lid being rotatable from a fully closed position to a fully removed position with less than one full rotation of the upper lid portion.

35. The beverage dispenser of claim 34, the dispenser lid being rotatable from the fully closed position to the fully removed position with less than one-half of a full rotation of the upper lid portion.

* * * * *